US005437531A

United States Patent [19]

Kress

[11] Patent Number: 5,437,531

[45] Date of Patent: Aug. 1, 1995

[54] VEHICLE FOR REACHING, LIFTING, RETRACTING, STACKING AND CARRYING LOADS

[75] Inventor: Edward S. Kress, Brimfield, Ill.

[73] Assignee: Kress Corporation, Brimfield, Ill.

[21] Appl. No.: 78,607

[22] Filed: Jun. 16, 1993

[51] Int. Cl.[6] ..... E02F 3/36

[52] U.S. Cl. ..... 414/555; 280/766.1; 212/304; 414/546; 414/734; 414/694

[58] Field of Search ..... 414/546, 547, 550, 555, 414/663, 665, 666, 667, 668, 669, 670, 671, 680, 685, 694, 705, 729, 731, 732, 733, 734, 735, 736, 737, 738, 739, 917; 280/763.1, 765.1, 766.1; 212/189

[56] References Cited

U.S. PATENT DOCUMENTS

| | | | |
|---|---|---|---|
| 2,599,991 | 6/1952 | Hegre . | |
| 2,998,143 | 8/1961 | Sundin . | |
| 3,232,460 | 2/1966 | Rouse . | |
| 3,239,080 | 3/1966 | Corompt . | |
| 3,253,716 | 5/1966 | Stratton . | |
| 3,263,834 | 8/1966 | Tendresse . | |
| 3,278,058 | 10/1966 | Symmank . | |
| 3,279,622 | 10/1966 | Person | 212/189 |
| 3,342,361 | 9/1967 | Melin . | |
| 3,487,964 | 1/1970 | Riley . | |
| 3,501,035 | 3/1970 | Whiting . | |
| 3,876,093 | 4/1975 | Carriere . | |
| 3,945,666 | 3/1976 | Fritsch | 280/765.1 |
| 4,084,777 | 4/1978 | Lambert | 280/766.1 |
| 4,163,625 | 8/1979 | Jenkins | 414/508 |
| 4,236,643 | 12/1980 | Schmitz | 414/694 |
| 4,373,854 | 2/1983 | Schultheis | 414/911 X |
| 4,390,314 | 6/1983 | Oberg | 414/547 |
| 4,424,985 | 1/1984 | Holmes | 280/766.1 |
| 4,632,630 | 12/1986 | Maki et al. | 414/700 |
| 4,762,291 | 8/1988 | Sauber | 414/555 |
| 4,969,789 | 11/1990 | Searle | 414/719 X |

*Primary Examiner*—Michael S. Huppert
*Assistant Examiner*—James Eller
*Attorney, Agent, or Firm*—Leydig, Voit & Mayer, Ltd.

[57] ABSTRACT

A vehicle for reaching, lifting, retracting, stacking and carrying loads. The vehicle includes a load carrying portion disposed behind the front axle of the vehicle for receiving and transporting loads, so that the vehicle is able to transport loads without tipping yet without carrying excess ballast. The vehicle includes a reach and retract lifting device for reaching to secure or release loads substantially far from the vehicle and retracting to secure or release loads stacked on the load carrying portion of the vehicle. The reach and retract lifting device is interchangeable depending on the desired lifting operation. To prevent tipping while reaching loads, the vehicle incorporates selectively actuable outriggers. Additionally, the vehicle includes selectively actuable hydraulic cylinders or the like for adjusting the lateral position of a lifted load.

14 Claims, 13 Drawing Sheets

FIG. 11a
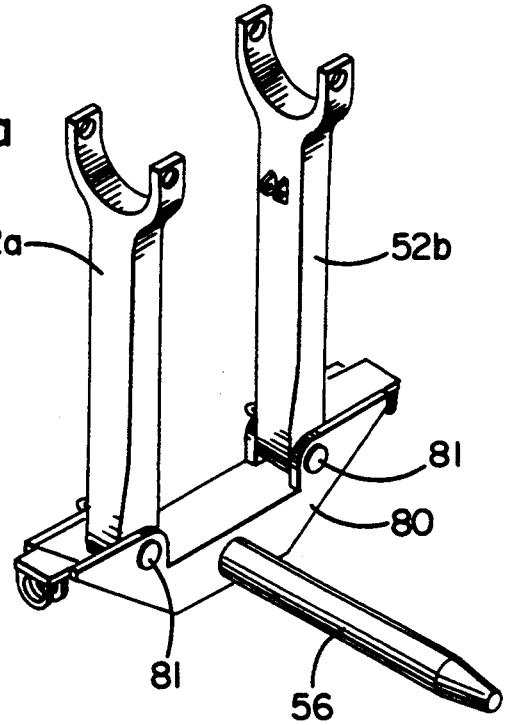
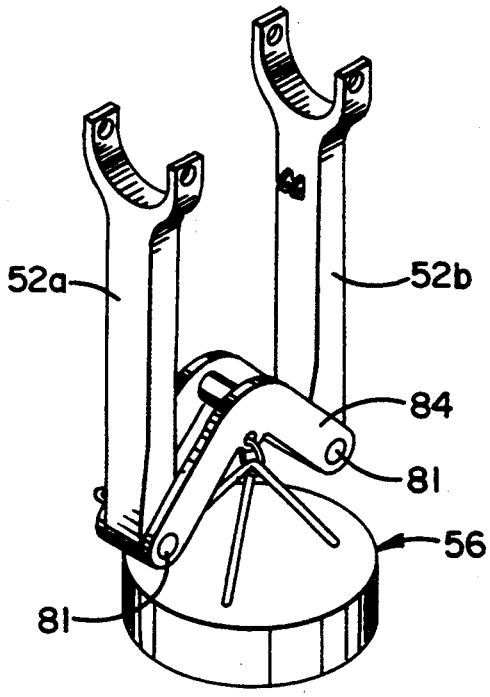
FIG. 11c
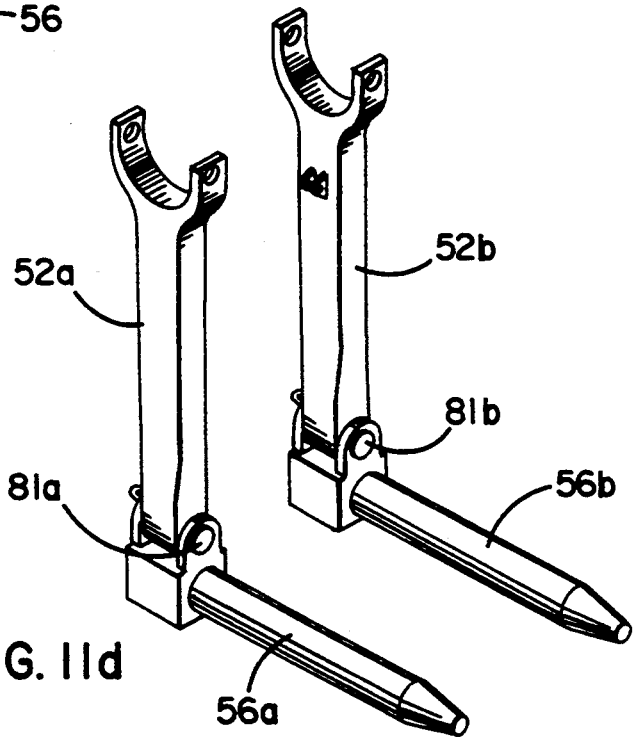
FIG. 11d

VEHICLE FOR REACHING, LIFTING, RETRACTING, STACKING AND CARRYING LOADS

FIELD OF THE INVENTION

The present invention relates generally to a vehicle for handling heavy loads, and more particularly to a vehicle for reaching, lifting, retracting, stacking and carrying heavy loads.

BACKGROUND OF THE INVENTION

Conventional load-lifting and load-carrying vehicles utilize their lifting mechanisms to also carry loads, which are generally positioned in front of the front axle of the vehicle prior to lifting. Once lifted, the loads are also carried in front of the front tires.

When dealing with heavy loads, for example steel billets or slabs, this substantially limits the amount of weight that the vehicle can lift and carry without tipping forward. This situation is aggravated the further the load and the lifting mechanism extend in front of the vehicle. Moreover, when attempting to transport such a lifted load the vehicle is even more likely to tip forward as it encounters bumps in the road, uneven terrain, swinging or shifting of loads, and so on.

To prevent tipping, such vehicles are required to have a rather long wheelbase, to have a substantial dead vehicle weight, and to carry a substantial amount of ballast in order to increase their moments counteracting tipping, both when lifting and transporting heavy loads. Accordingly, a substantial amount of the weight being moved by the vehicle is not the payload. This generally makes the vehicle unwieldly long or unduly heavy and consequently unsuitable for anything except for lifting and transporting heavy loads for short distances.

Additionally, the amount of weight that the vehicle can transport is limited to the maximum amount the vehicle can lift at any one time, which is dependent on both the strength of the lifting mechanism and most importantly the moment counteracting tipping of the vehicle. Moreover, the lifting mechanisms of such vehicles are subjected to strains and fatigue as a result of having to support the dead and dynamic weight during the transporting operations.

Without carrying a great deal of ballast to prevent tipping, these conventional vehicles have limited capabilities when attempting to lift a maximum load. As a result, the vehicle must be driven relatively close to the load in order to reach the load to be lifted. Similarly, the vehicle must be substantially centered in the lateral direction relative to the load since the load cannot be laterally adjusted when lifted. Accordingly, such vehicles are limited in their flexibility when attempting to secure and manipulate a load.

OBJECTS AND SUMMARY OF THE INVENTION

It is a primary aim of the present invention to provide a vehicle capable of lifting and retracting a load for positioning or depositing the load on the vehicle frame such that the center of gravity of the load is over or inboard of the vehicle axle behind the tipping point of the vehicle thereby substantially increasing the amount of weight the vehicle can safely transport.

It is a related object of the present invention to provide a vehicle capable of carrying a heavy load having a weight exceeding the capacity of a single lifting operation.

Another related object is to provide a vehicle capable of utilizing its lifting mechanism for stacking a load on the vehicle itself for transporting the load apart from the mechanism.

Another object of the invention is to provide a vehicle as characterized above for reaching and stacking loads located substantially away from the vehicle.

Yet another object is to provide a vehicle of the above kind for reaching and lifting maximum loads substantially far from the vehicle without tipping and without requiring undue vehicle length or weight or excess ballast.

Yet another object is to provide such a high-capacity lift vehicle having interchangeable types of lifting devices.

Still another object is to provide a vehicle having means for adjusting the lateral position of the lifting mechanism or of a lifted load.

Briefly, the present invention provides a load handling vehicle having a main frame supported on a plurality of wheels which define the wheelbase of the vehicle. The main frame supports a lift means, which includes a lift frame pivoted to the main frame and power means for pivotally raising and lowering the lift frame. Pivotally connected to the lift frame is a reach and retract means including at least one articulated load support element. Load securing and releasing means for connecting a load thereto are carried by the support element.

Articulating power means are provided for swinging the support element outwardly relative to the lift frame for securing or releasing a load located outboard of said main frame and the wheelbase and for swinging the support element inwardly relative to the lift frame for carrying the load inboard of the wheelbase.

Other objects and advantages will become apparent from the following detailed description when taken in conjunction with drawings, in which:

BRIEF DESCRIPTION OF THE DRAWINGS

FIGS. 11a–11d are perspective views showing alternative arrangements for supporting lifting mechanisms for securing loads thereto.

Figure 1:
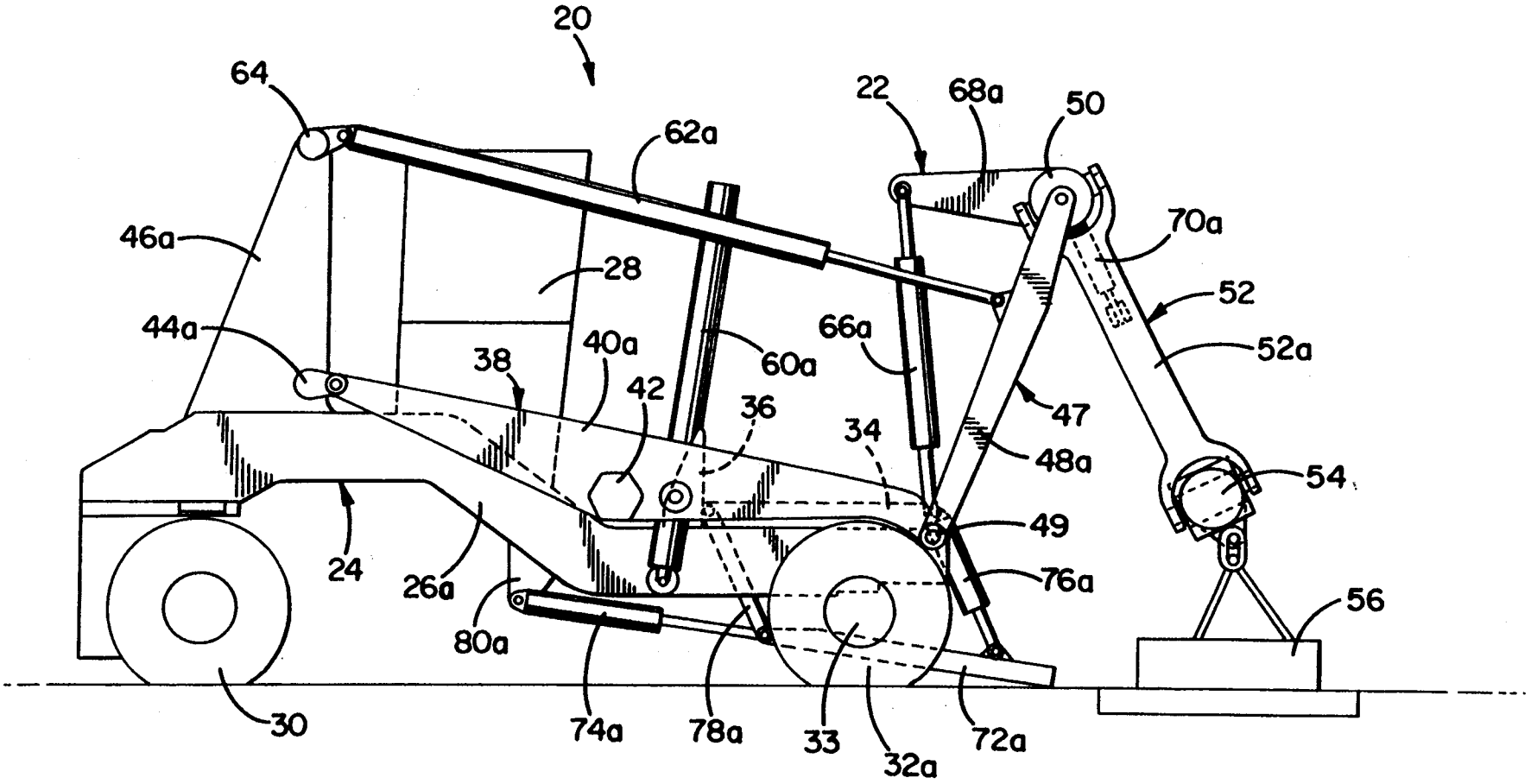
FIG. 1 is a side elevational view illustrating the load handling vehicle according to the invention preparing to lift a load in front of the vehicle with the outriggers substantially extended.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Turning to FIGS. 1–12 of the drawings, there is shown a vehicle 20 embodying the invention including a reach-and-retract means (i.e. assembly) 22 for reaching, lifting and retracting heavy loads located in front of the vehicle 20. The vehicle 20 includes a main frame 24 having side beams 26a and 26b extending in a longitudinal direction substantially over the length of the vehicle 20.

Supported on the main frame 24 toward the rear of the vehicle 20 is an operator's cab 28. It should be noted that the front of the vehicle 20 is defined herein as the general location where the load is located for lifting, while the operator's cab 28 is near the rear of the vehicle 20. Additionally, for ease of understanding herein, components, subassemblies and the like which have a symmetrical counterpart on an opposite side are numbered such that from the perspective of the driver (i.e. looking forward from the cab) the right side is denoted by the lower case letter "a" and the left side by the lower case "b."

Figure 8:
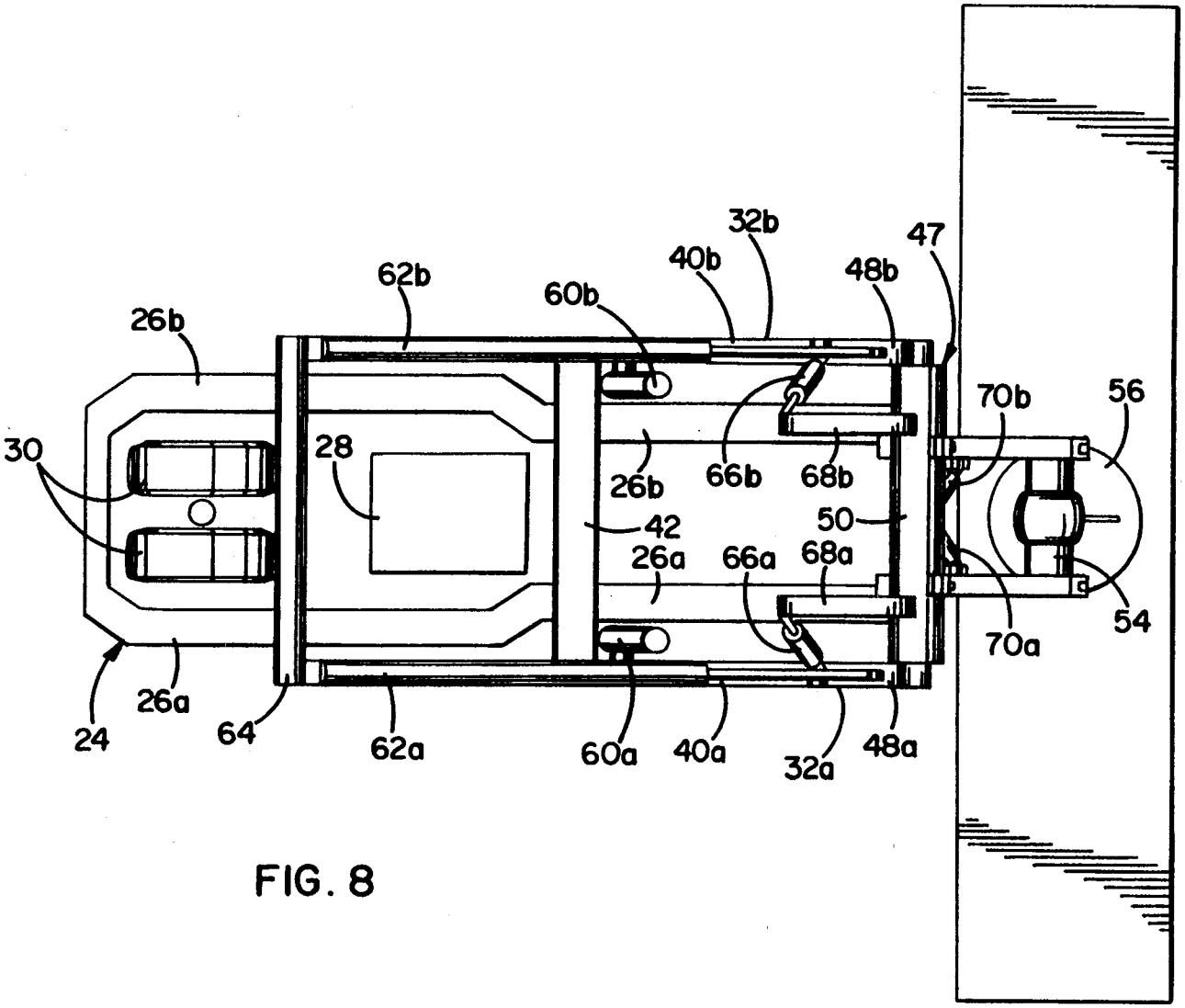
FIG. 8 is a top plan view showing the vehicle lifting a load in front of the front axle.
Figure 10:
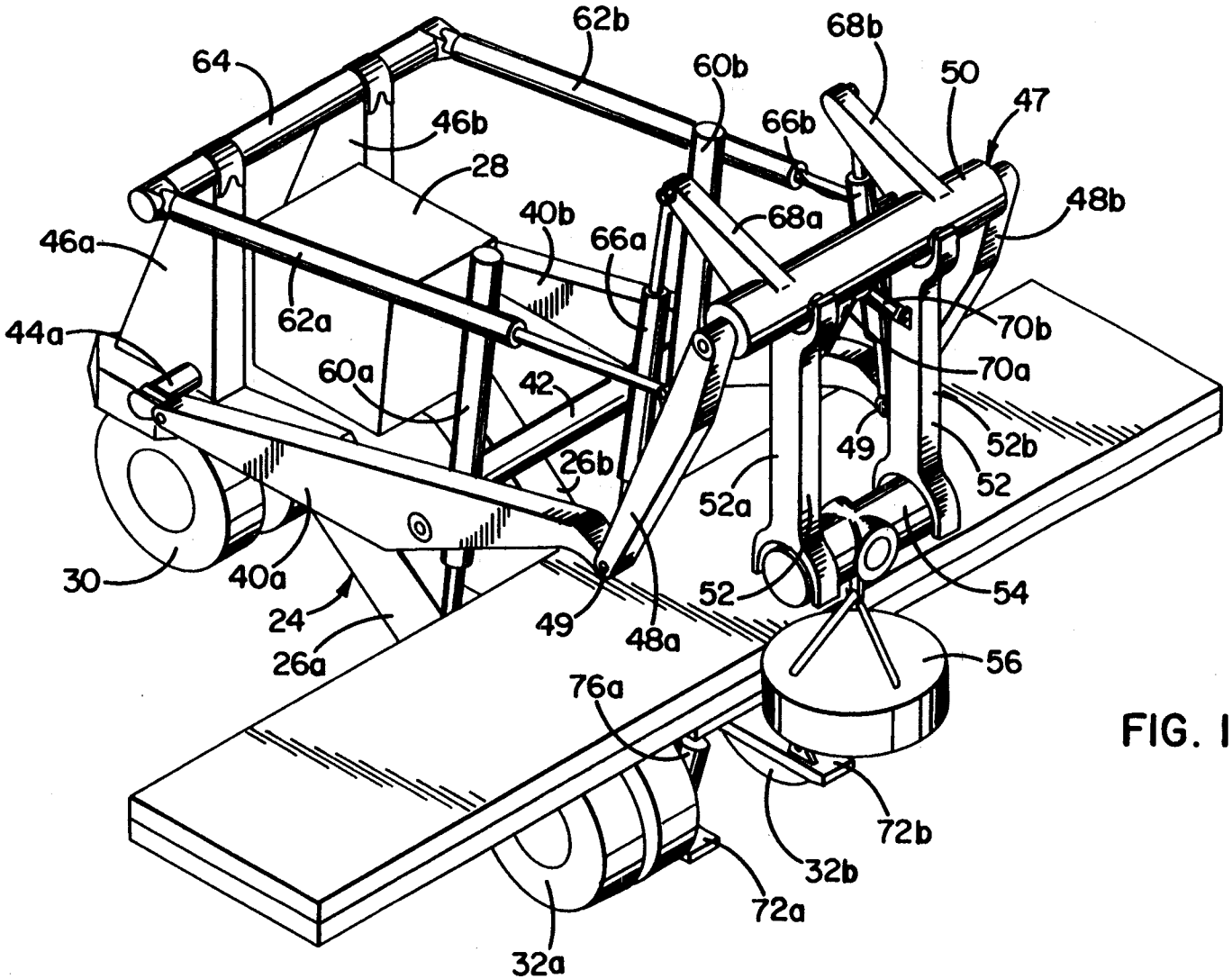
FIG. 10 is a perspective view of the vehicle according to the invention illustrating the vehicle carrying a stacked load upon itself.

As best shown in FIGS. 8 and 10, the main frame 24 is supported on a plurality of wheels 30, 32a–32b, preferably designed such that the wheelbase is arranged as an isosceles triangle configuration with a steerable rear wheel system 30 and two front wheels 32a, 32b acting as the support points. However, because of the relatively heavy loads intended to be lifted and to provide enhanced weight carrying capability, each support point is preferably arranged as a dual-wheel system, having a wheel pair with conventional air-inflated tires mounted thereon.

In the preferred embodiment, the vehicle 20 is intended to be completely self-propelled. To this end, the front wheels 32a, 32b are preferably driven through a suitable gear train and transmission in a conventional manner to a self-contained engine operated from the operator's cab 28. To steer the vehicle 20, the rear wheel pair is coupled to a conventional steering mechanism also controlled from the cab 28. Nevertheless, it can be readily appreciated that such a vehicle 20 could, if desired, be towed in a tractor-trailer arrangement.

According to one aspect of the invention, the vehicle 20 includes a load carrying portion for stacking loads thereon such as a load carrying platform 34 disposed above and substantially behind the centerline (i.e., axle) defined by its front tires 32a, 32b. It can readily be appreciated that the load carrying portion may be arranged as a unitary surface across the front of vehicle or as separate platforms above each tire, however it is important that the load carrying portion be disposed behind the front axle 33 (i.e., inboard of the wheelbase) such that the weight of stacked loads increases, rather than decreases, the moment counteracting tipping of the vehicle 20. The platform 34 is preferably supplemented with an upright back guard 36 to prevent loads from being retracted too far where it might damage the vehicle 20, particularly the several hydraulic cylinders and their associated supply and return lines.

Because the centerline of the front tires 32a, 32b acts as the balancing point, or tipping fulcrum during transporting operations, and because the load-carrying platform 34 is substantially behind the front axle 33, the center of gravity of the load is shifted to the vehicle side of the tipping fulcrum so that the vehicle 20 is capable of transporting a substantial amount of weight without tipping and without carrying excess ballast. Indeed, the greater the load stacked upon the platform 34, the greater the moment counteracting tipping, since the weight of the load adds to the weight of the vehicle 20. Thus, unlike conventional lift vehicles, the vehicle 20 of the present invention both acts as a lifting vehicle and as a transport vehicle that carries a load upon its frame. Additionally, by utilizing the platform 34 to carry loads, the vehicle 20 is able to transport an aggregate load substantially greater than the maximum weight that the vehicle 20 can lift without tipping.

For lifting loads, the vehicle 20 includes a lift means arranged as an H-shaped lift frame 38 including a pair of longitudinally extending lift arms 40a–40b rigidly connected together near their centers by a stabilizing crossbeam 42. The lift frame 38 is attached to the main frame 24 near the rear of the vehicle 20, with each lift arm being pivotably connected at transversely aligned points via a pivot pin 44a, 44b or the like projecting from a support 46a, 46b mounted on each side of the main frame 24 near the rear of the vehicle 20.

According to another aspect of the invention, to enable loads to be carried inboard of the wheelbase of the vehicle 20, and, if desired, stacked and removed from the load-carrying platform 34, a reach-and-retract assembly 22 is pivotally coupled to the lift arms 40a, 40b at their vertically displaceable ends, i.e., at the front of the H-shaped lift frame 38. The reach-and-retract assembly 22 includes at least one articulated load support element for connecting a load thereto. In the preferred embodiment, the load support element comprises a generally rigid tilt frame 47 including a right and left pair of upright members 48a, 48b pivotably coupled by pins 49 at their lower ends to the corresponding right and left lift arms 40a, 40b adjacent their vertically displaceable ends. The two upright members 48a, 48b are arranged to pivot in the same plane as the plane in which the lift arms 40a and 40b are upwardly rotated. In other words, taken together the pivot pins 49 where the lift arms 40a, 40b and upright members 48a, 48b are coupled essentially constitutes an elbow joint, with the upright members 48a, 48b effectively acting to extend and retract the length of the lift arms 40a, 40b in a bendable fashion.

Between the upper ends of the upright members 48a, 48b, a cylindrically-shaped crossbeam is pivotably coupled to act as a transverse support element 50 for suspending a swing frame assembly 52 therefrom. In the preferred embodiment, the swing frame includes right and left depending strut members 52*a* and 52*b* coupled to the transverse support element 50. The swing frame 52 is rigidly coupled to the transverse support element 50 with respect to longitudinal movement, such that if the transverse support element 50 is rotated around its axis, the swing frame 52 will likewise be rotated and therefore swing up and down vertically according to the amount the transverse support crossbeam 50 is rotated.

Figure 6:
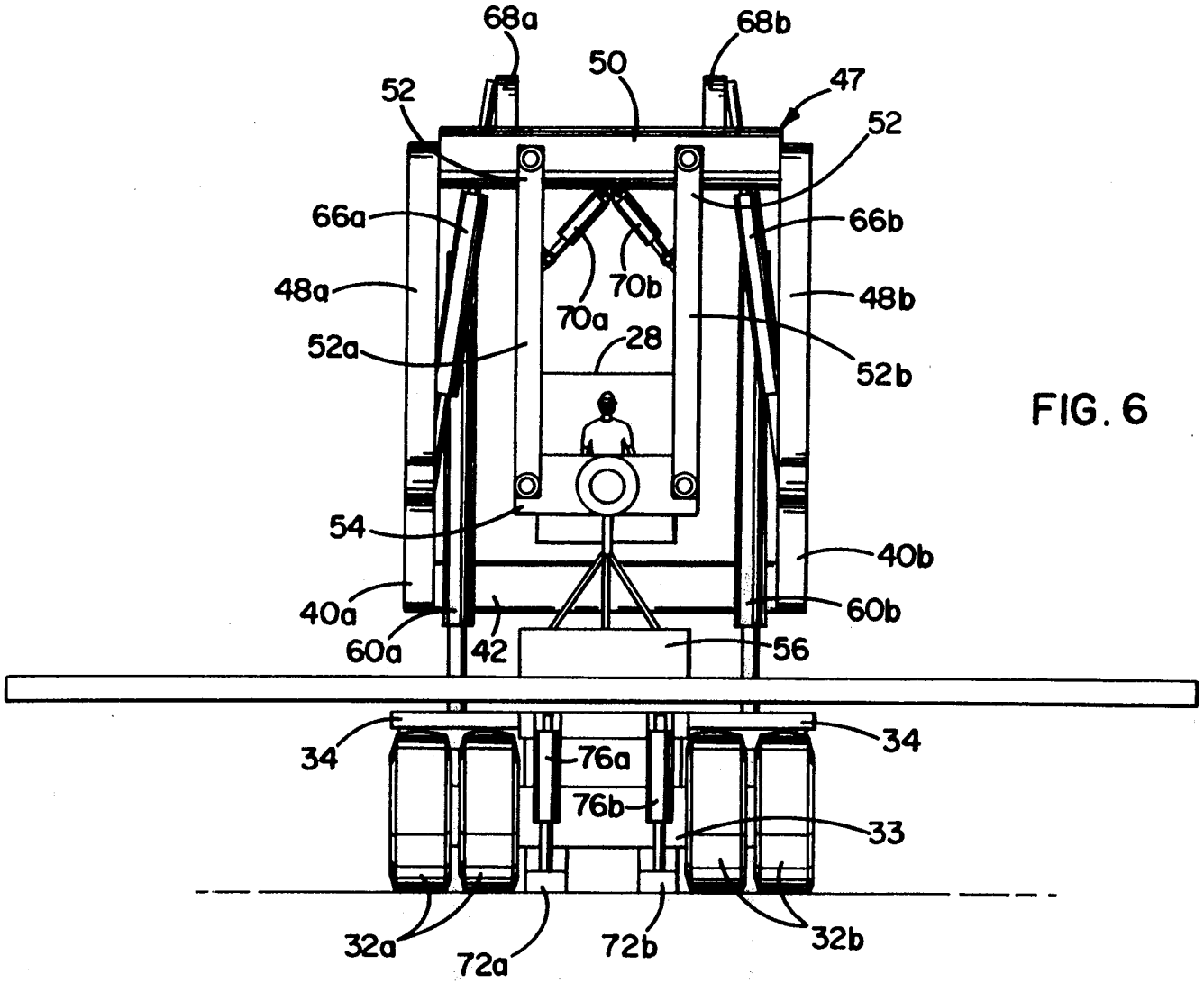
FIG. 6 is a front view illustrating the vehicle preparing to stack a substantially centered lifted load upon itself with the outriggers deployed.
Figure 7:
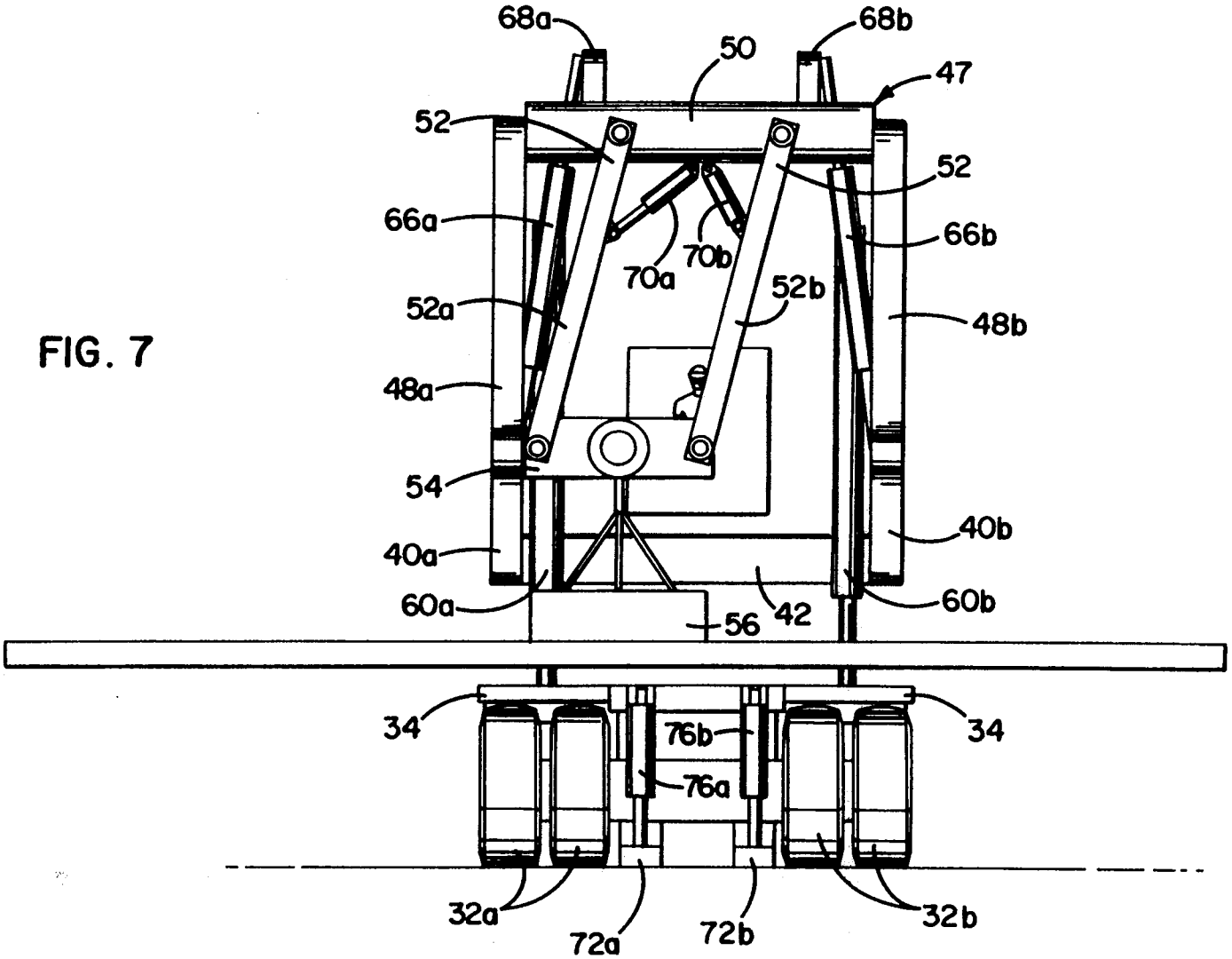
FIG. 7 is a front view illustrating the vehicle with the outriggers deployed utilizing its lateral shift capabilities to secure a load at the lateral center thereof when the load is not laterally centered relative to the vehicle.

Pursuant to another feature of the invention and as best shown in FIGS. 6–7, the right and left strut members 52*a*, 52*b* are coupled to the transverse support element 50 in a manner that allows a lateral swinging movement relative to the support element 50. In other words, the swing frame 52 is laterally adjustable relative to the main frame 24, i.e., it can shift either to the left or to the right. As a result, loads which are lifted other than at their lateral centers are maneuverable in the transverse direction prior to stacking upon the stacking platform 34 of the vehicle 20.

Transversely connected between the lower or depending ends of the boom members 52*a*, 52*b* is a crossbeam 54 for holding means for securing a load, i.e., a lifting device 56 such as an electromagnet, a clamping tong assembly or the like. The crossbeam 54 is preferably arranged as a universal joint to hold the lifting device both longitudinally and transversely level regardless of the orientation of the strut members 52*a*, 52*b*, i.e., their vertical angle relative to the ground or their lateral angle. Thus, by appropriately controlling the lifting device 56 in conjunction with lift frame 38, the amount of reach or retract of the upright members 48*a*, 48*b* connected thereto, and the lateral and vertical strut angle, a load is able to be reached, secured, lifted, maneuvered and released in a highly flexible yet precisely controlled manner.

Figure 9A:
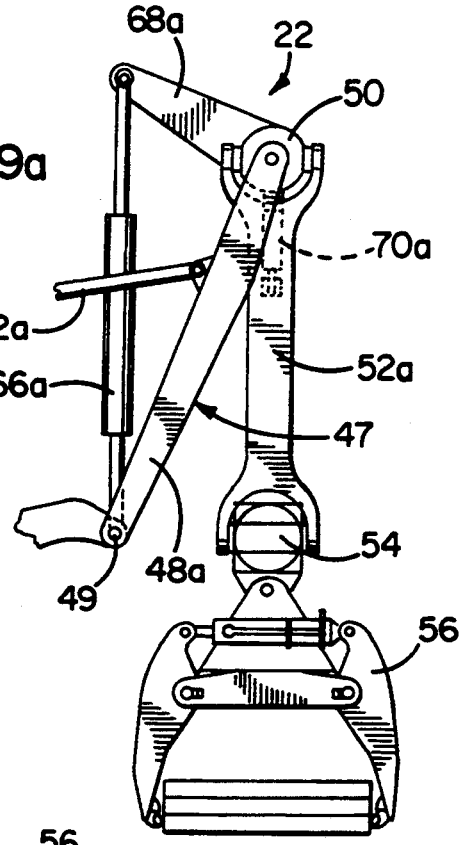
FIGS. 9a–9c are side views showing the reach-and-retract means of the vehicle having three alternative interchangeable means for securing the load thereon.
Figure 9B:
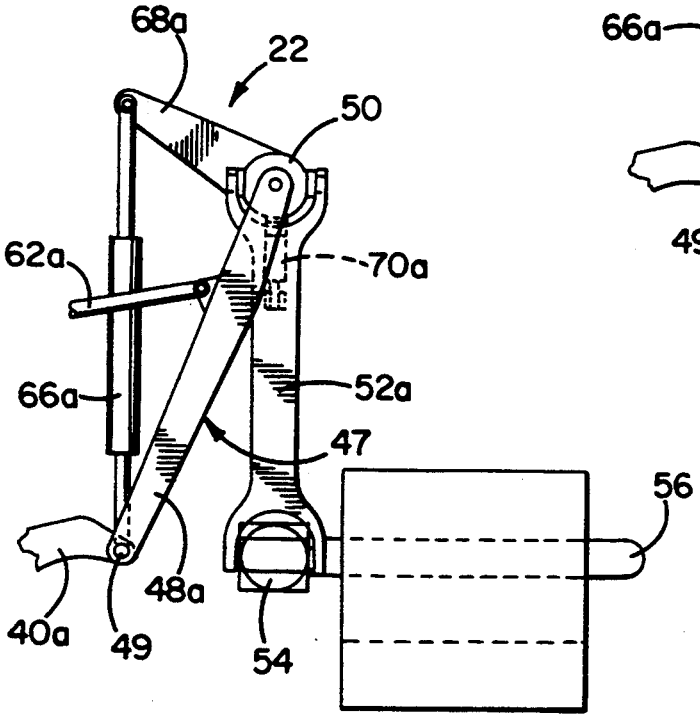
Figure 9C:
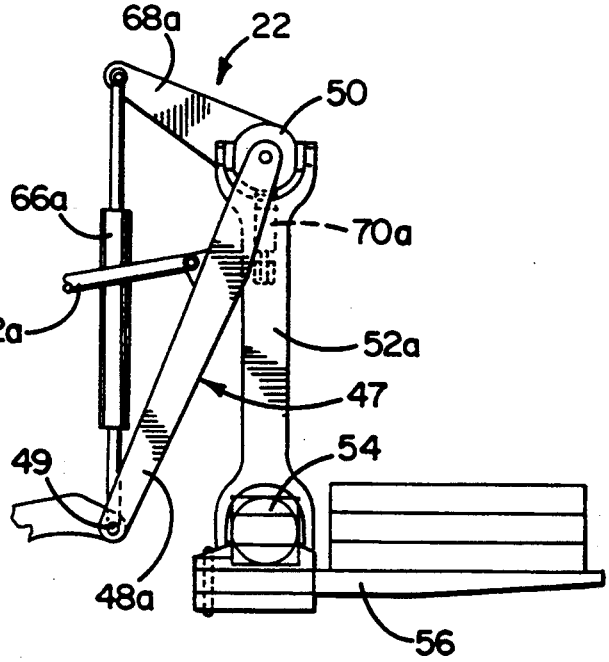

As shown in FIGS. 9*a*–9*c*, the lifting device 56 is designed to be interchangeable depending on the type of load to be secured. For example, in FIG. 9*a* a clamping tong assembly having at least one pair of tongs actuated by a hydraulic cylinder serves as the lifting device 56. Alternatively, FIG. 9*b* illustrates a projecting prong useful for lifting coils or the like by inserting the projecting member through a hollow center prior to lifting. Similarly, FIG. 9*c* illustrates a conventional forklift type of lifting device 56.

Figure 11B:
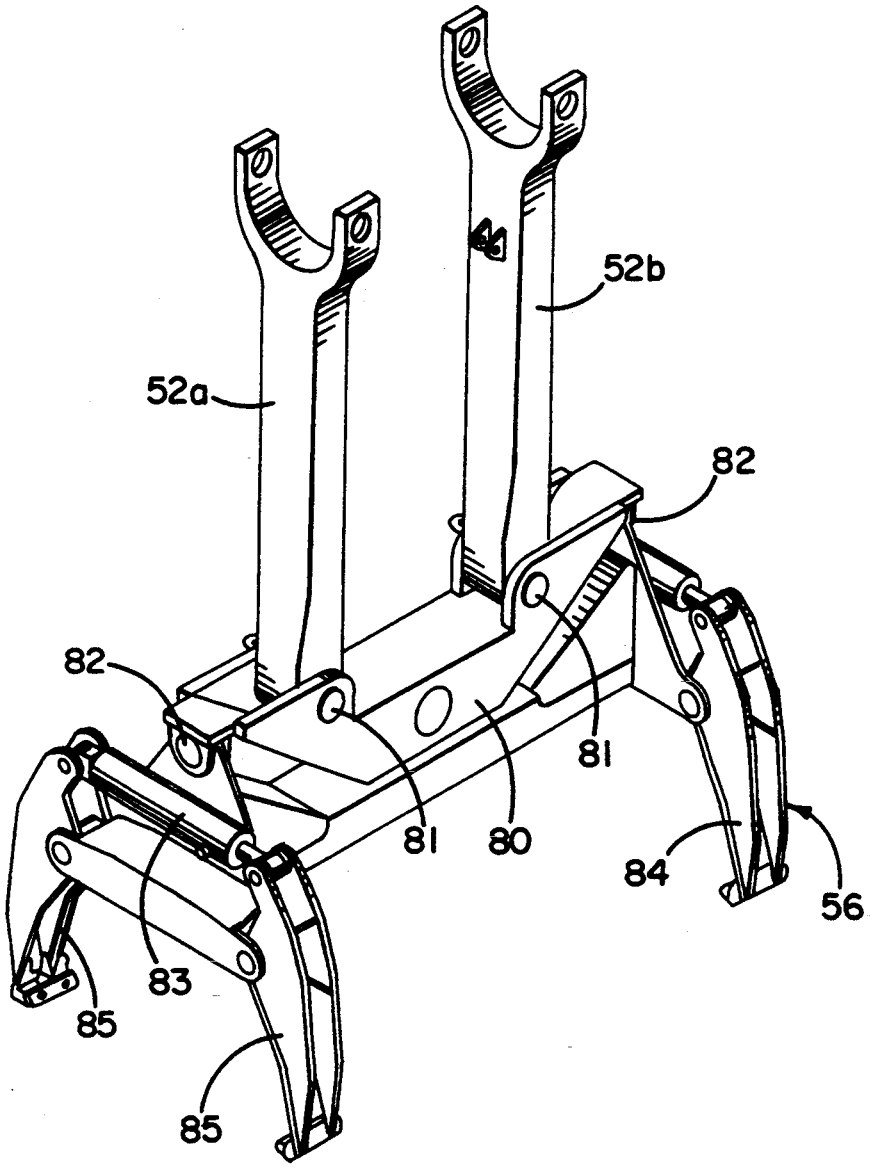

As shown in FIGS. 11*a*–11*d*, the strut members may alternatively support a number of various mechanisms for supporting the lifting devices 56. For example, FIG. 11*a* illustrates a transverse support member 80 wherein a projecting prong acts as the lifting device 56. In this embodiment, the transverse support member 80 is pivotally connected to the strut members 52*a* and 52*b* at pins 81.

As shown in FIG. 11*b*, the same transverse support member 80 can alternatively support an actuable tong assembly acting as the lifting device 56. In this embodiment, the transverse support member 80 is pivotally connected to the strut members 52*a* and 52*b* at pins 81, while the tong assembly is pivotally coupled to transverse support member 80 at pins 82. Clamping cylinders 83 are actuated to open and close the pairs of tongs 84, 85.

In yet another embodiment as illustrated in FIG. 11*c*, an inverted V-shaped transverse support member 84 is utilized to support an electromagnet acting as the lifting device 56. Again, the support member 84 is pivotally connected to the strut members 52*a* and 52*b* at pins 81. The inverted V-shaped support member 84 is utilized to elevate the electromagnet as close as possible to the strut members 52*a* and 52*b* such that highly stacked loads can be vertically cleared.

Figure 12:
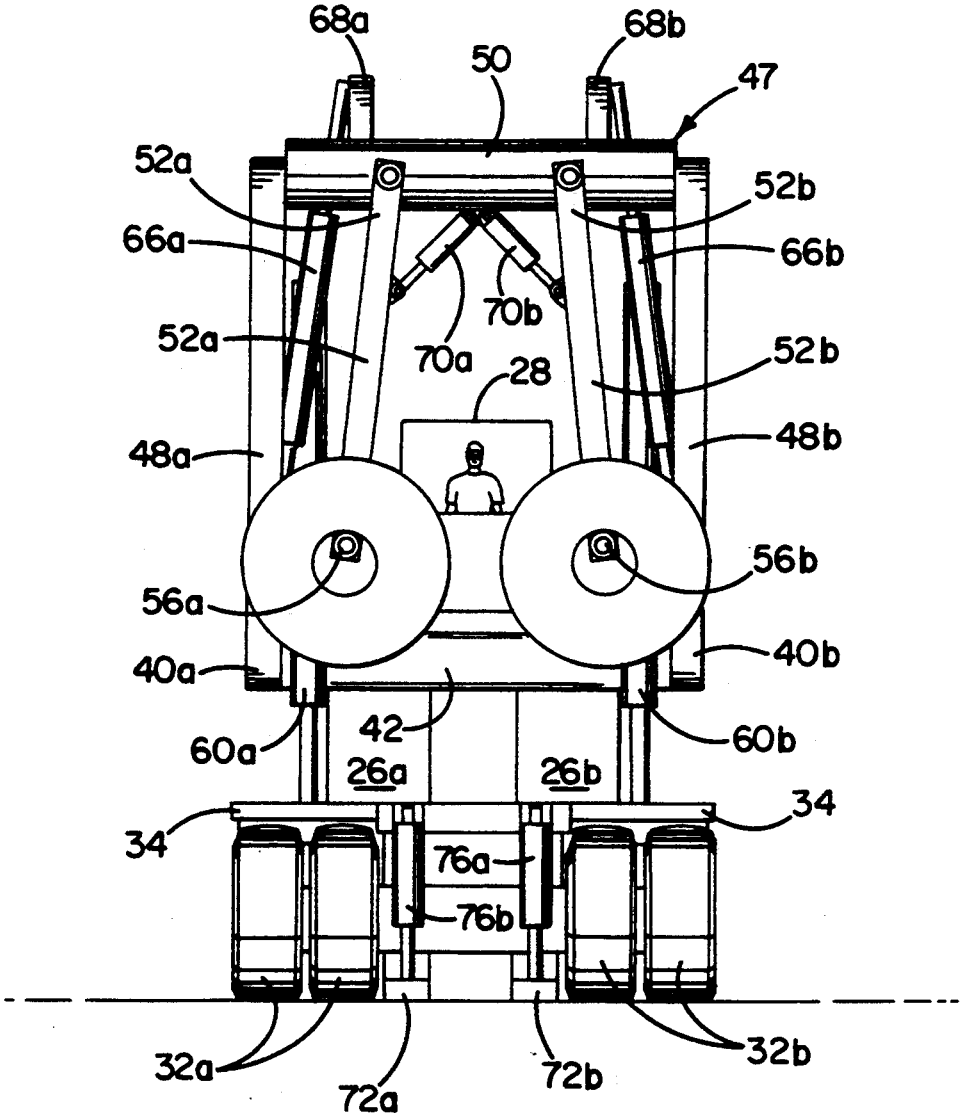
FIG. 12 is a front view illustrating the vehicle lifting two separate loads with independent lateral shifting.

FIG. 11*d* illustrates two separate prongs pivotally connected to strut members 52*a* and 52*b* at pins 81*a* and 81*b*. In this manner, two coils or the like can be simultaneously secured for lifting, as illustrated in FIG. 12 and described in more detail hereinbelow.

Turning now to a consideration for the primary lifting capabilities of the vehicle 20, i.e., the raising and lowering of the H-shaped lift frame 38 and consequently the reach-and-retract assembly 22 connected thereto, a right and left pair of hydraulic lifting cylinders 60*a* and 60*b* are trunnion mounted to the corresponding right and left lift arms 40*a*, 40*b* of the lift frame 38 near the centrally located crossbeam 42. The pistons of the lifting cylinders 60*a*, 60*b* are pivotably mounted to the sides of the main frame 24. Accordingly, as these lift cylinders 60*a*, 60*b* are extended, the downward force pressing on the main frame 24 swings the front end of the lift frame 38 (and the attached reach-and retract assembly 22) vertically upwards, the rear of the lift arms 40*a*, 40*b* pivoting at their supports 46*a*, 46*b* on the main frame 24. Conversely, as the lifting cylinders 60*a*, 60*b* are retracted, the lift frame 38 swings downwardly.

To control the angle of the tilt frame 48 including the upright members 48*a*, 48*b* relative to the lift arms 40*a*, 40*b*, and consequently provide the principal reaching and retracting capabilities of the vehicle 20, a right and left pair of hydraulic cylinders 62*a*, 62*b* are connected at their piston ends to the upright members 48*a*, 48*b* near their upper ends. The opposite ends of these reach-and-retract cylinders 62*a*, 62*b* are coupled to the upper ends of the main frame supports 46*a*, 46*b* via a rotatable common shaft 64 (see FIG. 10). Accordingly, extending and retracting the pistons of these cylinders varies the angle of the tilt frame 48 and upright members 48*a*, 48*b* relative to their respective lift frame 38 and lift arms 40*a*, 40*b*, thus reaching out or retracting the reach-and-retract assembly 22. In other words, these reach-and-retract cylinders 62*a*, 62*b* flex the elbow joints represented by the pivot pins 49. It should be noted that the pistons of the reach-and-retract cylinders 60*a*, 60*b* are coupled to the upright members 48*a*, 48*b* substantially in parallel with the lift arms 40*a*, 40*b*, and thus the shaft 64 enables the cylinders 62*a*, 62*b* to pivot and therefore rise and fall as the lift frame 38 is raised and lowered. In this way, a parallel relationship is maintained between the reach-and-retract cylinders 62*a*, 62*b* and the lift frame arms 40*a*, 40*b*.

Thus, the extension and retraction of the reach-and retract cylinders 62*a*, 62*b* control the angle between each upright member 48*a*, 48*b* of the tilt frame 48 and its corresponding longitudinally extending lift arm 40*a*, 40*b*. As a result, they effectively extend and retract the vertical and longitudinal dimensions of the lift frame 38, primarily in order to stack and remove loads from the load carrying platform 34.

To control the vertical angle of the swing frame assembly 52, a pair of hydraulic cylinders 66*a*, 66*b* are coupled to the transverse support element 50 through a pair of substantially rearwardly projecting arms 68*a*, 68*b* rigidly connected thereto. As these cylinders 66*a*, 66*b* are extended or retracted, the arms 68*a*, 68*b* act as a pair of levers for turning the transverse support element 50 thereby controlling the angle of the depending swing frame assembly 52. Accordingly, by controlling these cylinders 66*a*, 66*b*, the reach-and-retract capability of the unit is enhanced by the swinging of the swing frame assembly 52, as well as the height that a load can be lifted. This feature provides added flexibility since the lifting, reaching, and retracting capabilities are not exclusively controlled by the lift frame 38 and the angle of the tilt frame 48 and upright members 48*a*, 48*b*, but also by the swinging of the swing frame assembly 52.

For controlling the amount of lateral strut movement, i.e., the lateral angle of the struts 52*a*, 52*b*, a pair of lateral control cylinders 70*a*, 70*b* are provided. The pistons of these cylinders 79*a*, 79*b* are individually connected to the right and left strut members 52*a*, 52*b*, while their opposite ends are connected to the transverse support element 50. As best shown in FIG. 6, the cylinders 70*a*, 70*b* are arranged such that when both are partially extended a substantially equal amount, the swing frame assembly 52 is substantially perpendicular to the transverse support element 50. As illustrated in FIG. 7, by extending one of the cylinders such as 70*b* while retracting the other cylinder 70*a* a corresponding amount, the swing frame struts 52*a*, 52*b* shift to the left or right, the swing direction depending on which cylinder is retracted and which is extended (shown in FIG. 7 as to the right of the operator). As described hereinbefore, since the load lifting device 56 is supported by a crossbeam 54 arranged as a universal joint, the load lifting device 56 and hence the load remains level and is shifted to the left or right in a controlled manner.

As shown in FIG. 12, the lower ends of the strut members 52*a* and 52*b* can be separated such that both are free to move in a lateral direction relative to each other. By independently controlling the cylinders 70*a* and 70*b*, each strut member 52*a* and 52*b* is laterally shifted an independent amount. In this manner, the operator has the capability of separating or bringing together two separate loads, in addition to being able to shift both loads in the same lateral direction. For example, when the separate dual prongs 56*a* and 56*b* (FIG. 11*d*) are employed for lifting coils or the like, coils having large outer diameters or otherwise having their inner diameters separated by a relatively wide lateral distance can be simultaneously lifted by separating the prongs an appropriate amount.

In accordance with another aspect of the invention and to further enhance the reaching capabilities of the vehicle 20 while lifting a standard load without tipping over, the vehicle 20 includes outrigger means for varying the effective longitudinal length of the vehicle 20 to provide a longer effective moment arm. To this end, the preferred embodiment includes adjustable outriggers 72*a*, 72*b* for extending the effective length of the vehicle 20 to make it more difficult for the vehicle 20 to tip over, particularly when reaching far in front of itself to lift a heavy load, and because little or no additional ballast is necessary due to the stacking of loads behind the front axle 33 as described hereinbefore.

The outriggers 72*a*, 72*b* are disposed on opposite sides of the vehicle 20 to the inside of the front wheels 32*a*, 32*b*. On each side, a pair of first hydraulic cylinders 74*a*, 74*b* are connected to the main frame 24 at supports 80*a* and 80*b* and are pivotally coupled at their piston ends to the outrigger runners 72*a*, 72*b* to control the longitudinal extension and retraction of the outrigger members 72*a*, 72*b*. At the same time, a second pair of hydraulic cylinders 76*a*, 76*b* are provided to controllably force the outrigger members 72*a*, 72*b* into engagement with the ground. For supporting the pivotable connections between the outriggers 72*a*, 72*b* and the cylinders 24*a* and 74*b*, pivoting links 78*a* and 78*b* are provided to couple the pivotable connections to the main frame 24, preferably adjacent the support platform 34.

Figure 3:
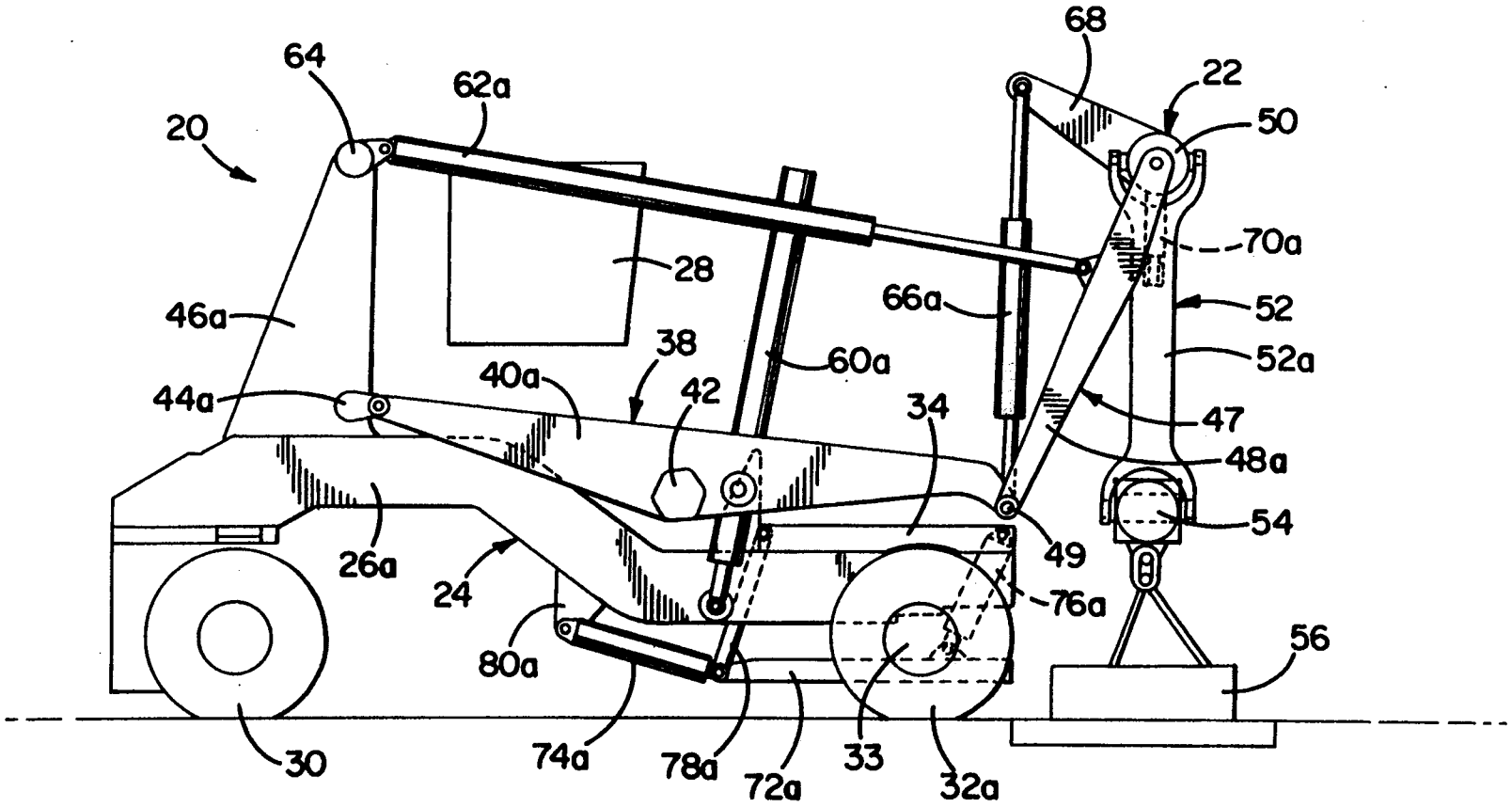
FIG. 3 is a side elevational view illustrating the vehicle of the present invention preparing to lift a load relatively close to the front of the vehicle with the outriggers not being deployed.
Figure 5:
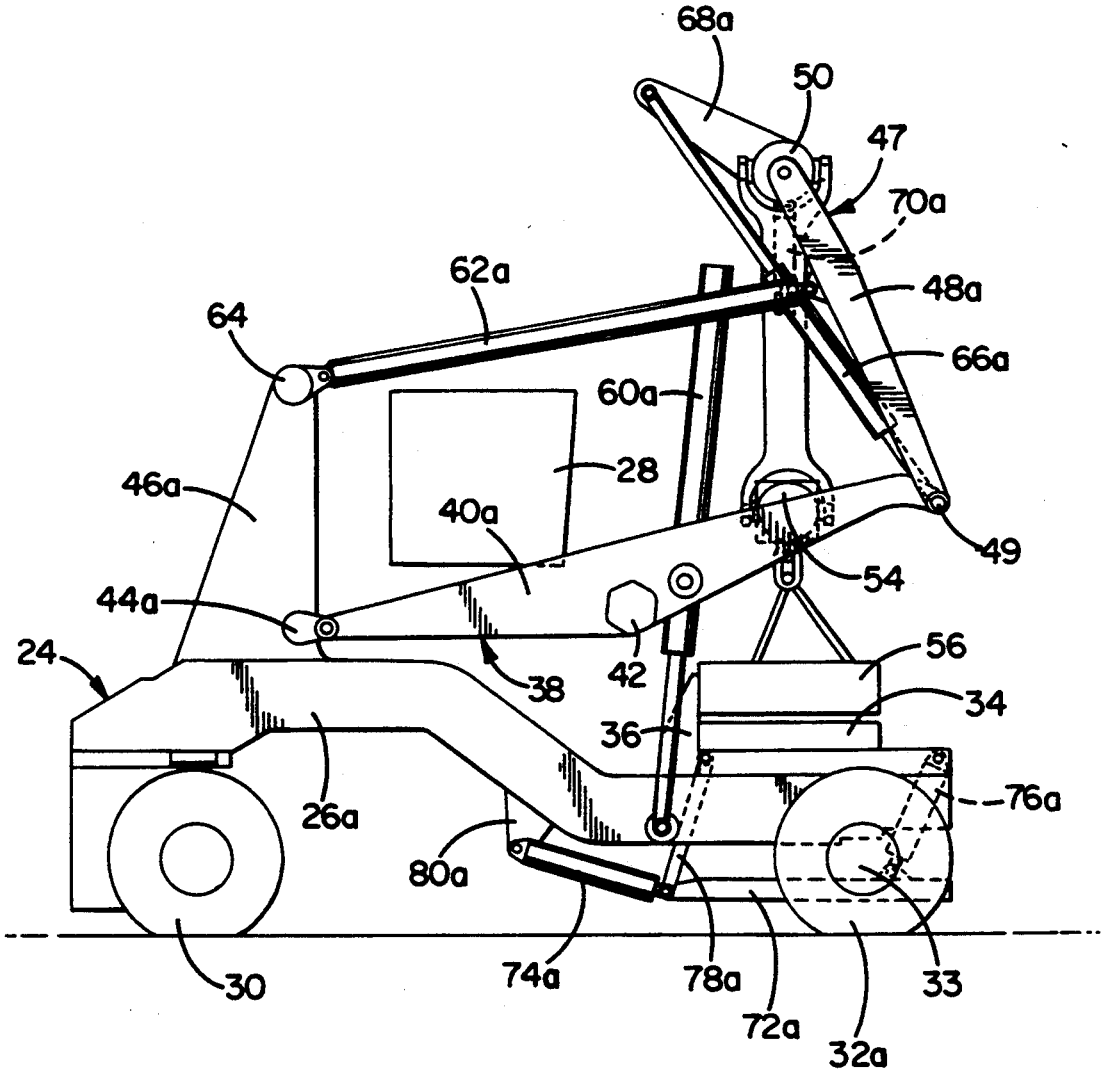
FIG. 5 is a side elevational view illustrating the vehicle just after stacking a lifted load upon itself such that the center of gravity of the load is inside the front axle.

As shown in FIGS. 3 and 5, when the outriggers 72*a*, 72*b* are retracted, the centers of the front wheels 32*a*, 32*b* act as a fulcrum balancing the weight of the load against the weight of the vehicle 20 including any ballast therein or load already stacked upon the platform 34. In this position, the further the boom is extended, the smaller the load required to tip the vehicle 20. Accordingly, without the outriggers extended, the maximum weight that the vehicle 20 can lift without tipping is limited by the length of the vehicle (from its center of gravity) to the balancing point (defined by the front tires) times the weight of the vehicle 20.

Figure 2:
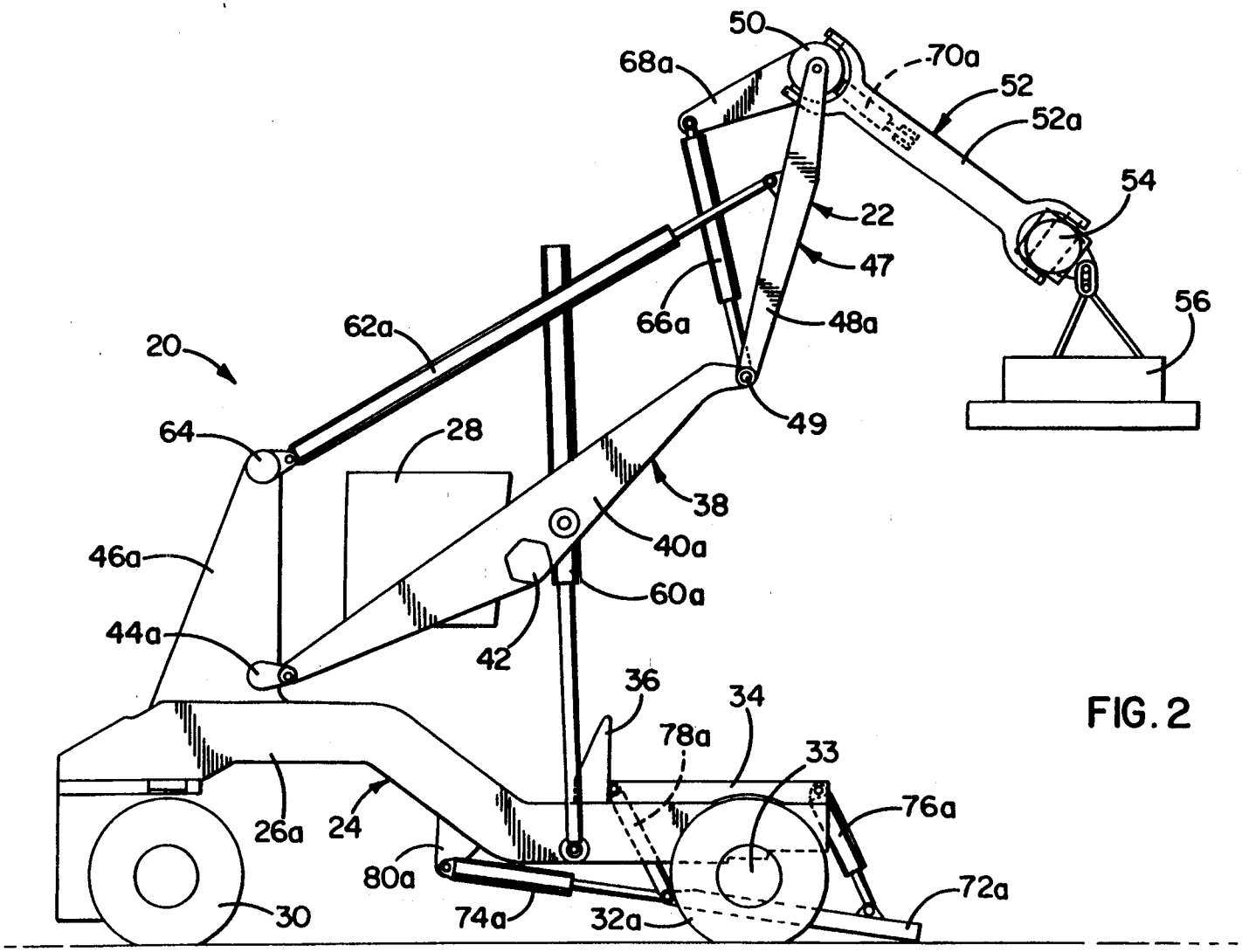
FIG. 2 is a side elevational view illustrating the vehicle of FIG. 1 lifting a load with the with the lift means substantially at a maximum extension.

When the outrigger cylinders 76*a*, 76*b* are extended such that the outrigger members 72*a*, 72*b* contact the ground, the balancing point or tipping fulcrum shifts from the centerline of the axle 33 to the outrigger members 72*a*, 72*b*, effectively increasing the length of the moment arm of the vehicle 20 and decreasing the moment arm of the load. As a result of the extension, the weight of the vehicle 20 with the increased effective length creates an increased counterbalancing moment and a decreased tipping moment and thus the amount of weight that the vehicle 20 can lift without tipping is greatly increased. As shown in FIGS. 1 and 2, the length can be extended further when reaching further. Indeed, in theory the effective length of the vehicle can be increased even further for heavier and more remotely positioned loads, subject only to the capabilities of the hydraulic cylinders and the strength of the metal components. Nevertheless, it can be readily appreciated that due to the nature and location of certain loads the outrigger members 72*a*, 72*b* are not always fully extendable, and thus it is valuable to be able to controllably adjust the amount of extension.

In operation, to relocate a load such as steel slabs, the vehicle 20 is first driven to the load and then oriented so that the load is within reach of the lifting device 56. As previously described, the vehicle 20 need not be perfectly positioned as a result of its longitudinal reach-and-retract capabilities in conjunction with its lateral adjustment capabilities.

Once in an appropriate position, the operator determines how to deploy the outriggers 72*a*, 72*b* (if at all) in dependence on the load weight and the amount of reach necessary to secure the load as described previously. To this end, the operator extends the right and left outrigger-positioning cylinders 74*a*, 74*b* an appropriate amount to move the outrigger members 72*a*, 72*b* beyond the front wheels 32*a*, 32*b*. Once the desired setting for the outriggers 72*a*, 72*b* is reached, the operator extends the outrigger engaging cylinders 76*a*, 76*b* to plant the front ends of the outrigger members 72*a*, 72*b* into the ground.

Once the outriggers are appropriately set into position, the operator ordinarily controls the lifting cylinders 60*a* and 60*b*, the reach-and-retract cylinders 62*a* and 62*b* and the swing angle control cylinders 66*a* and 66*b* as necessary for securing the load to the lifting device 56 at the end of the swing frame assembly 52. The actual order and amount of cylinder operations required varies according to the individual application being executed. For example, if the operator is controlling the forklift or coil lifting prong described hereinbefore, the lifting device 56 generally needs to be lowered to an appropriate level prior to moving the device 56 forwardly towards the load. Conversely, the electromagnet or tong assembly needs to be maneuvered above the load prior to lowering for pickup. Thus, the factors determining the cylinder operations include the initial cylinder positions, the distance the load is behind the vehicle 20, the height of the load, the type of lifting device, the amount of the load that can be lifted at any one time, and so on. It should also be noted that the operator might choose to reposition the vehicle 20 by driving it as necessary, although such movement would require temporarily raising the outriggers 72*a* and 72*b* if they have been deployed.

Assuming for reasons of simplicity that the electromagnet is being utilized to relocate a stacked load of steel slabs, the operator first elevates the lift frame 38 and angles the boom assembly 52 upwardly to a level sufficient to clear the load in the vertical direction. Once cleared, the reach-and-retract cylinders 62*a*, 62*b* are extended to position the electromagnet directly over the load. Subsequently, the lift frame 38 is lowered as far as necessary for the lifting device 56 to contact the load. It can be readily appreciated that since the lift frame 38 actually moves in an arcuate manner, the reach cylinders 62*a*, 62*b* are extended an additional amount either before or during the actual lowering of the lift frame 38 to compensate for the slight longitudinal movement that results. In any case, the load contacting position is illustrated in FIGS. 1 and 3. Indeed, it should be noted that the vehicle 20 is capable of lifting loads below ground level if necessary.

Figure 4:
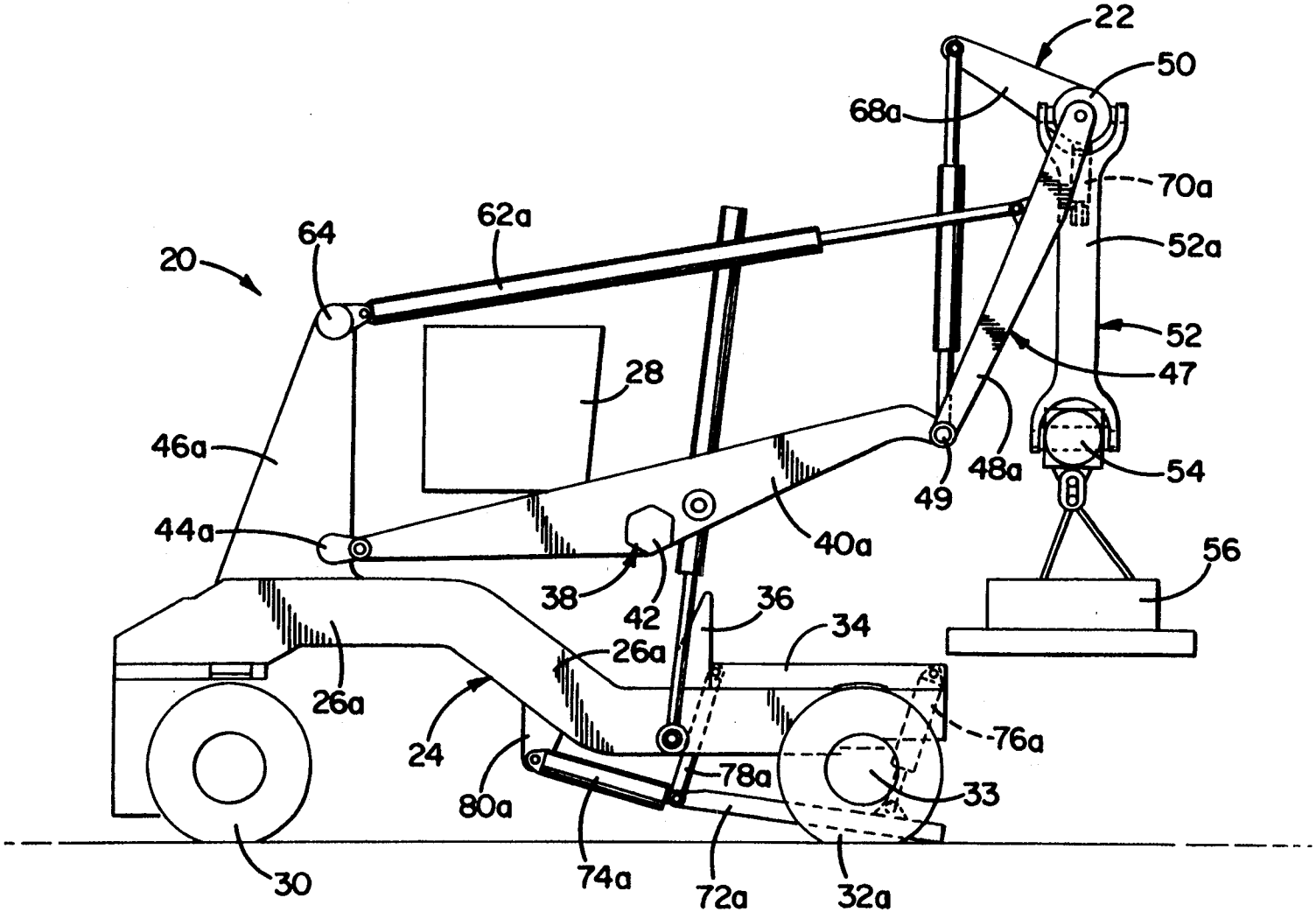
FIG. 4 is a side elevational view illustrating the vehicle lifting a load relatively close to the front of the vehicle with the outriggers contacting the ground within the envelope of the tires.

The operator next energizes the electromagnet in the conventional manner thus securing the uppermost steel slab in the load. The lift frame 38 is subsequently elevated an amount sufficient to raise the load above the height of the load carrying platform 34, for example, as shown in FIG. 4. Note that FIG. 2 shows the load being raised to a maximum vertical position, far beyond what is necessary for stacking the load upon the stacking platform 34 of the vehicle 20 but nevertheless useful for placing or removing loads from highly stacked positions.

To place the load upon the platform 34 of the vehicle 20, the operator then retracts the reach-and-retract assembly 22 by retracting cylinders 62*a* and 62*b*. This brings the load into the proper longitudinal position. Subsequently, the lift frame 38 is lowered as needed by retracting cylinders 60*a*, 60*b* until the slab rests just above the platform 34. If the slab is off-center in the lateral direction, the operator controls the lateral angle of the swing frame assembly 52 by operating the lateral boom-angle adjusting cylinders 70*a* and 70*b*. As described hereinbefore, this shifts the load to the left or right in a controllable amount. The operator then lowers the slab as needed, for example by lowering the lift frame 38 while making fine adjustments to other cylinders as necessary. When the slab is properly positioned, the electromagnet is ordinarily de-energized and the load is released. Nevertheless, it should be noted that merely retracting the load such that its center of gravity is inside of the wheelbase is sufficient for increasing the counterbalancing moment and decreasing the tipping moment, even if the load is not released onto the frame. Thus, some of the advantages are achieved by the retract capabilities of the invention even without stacking the load upon the frame when transporting a load.

In accordance with one aspect of the present invention, the slab is stacked behind the front axle 33 of the vehicle 20, i.e., inside the wheelbase. Thus, even without the outriggers deployed (when the front axle 33 acts as the fulcrum balancing point), the weight to the vehicle side of the fulcrum is increased. This prevents tipping during transporting operations when the outrigger members 72*a*, 72*b* are raised. Additionally, another slab may be lifted and stacked atop the first slab as shown in FIG. 10. Accordingly, the vehicle 20 can transport more weight than the electromagnet and the rest of the lifting mechanism can handle at any one time.

Once the load has been stacked upon the load carrying platform 34, the vehicle 20 is driven to transport the load to a desired location, where the load is ordinarily removed in the reverse manner.

As can be seen from the foregoing, a vehicle has been provided for reaching, lifting, retracting, stacking and carrying loads. Because the vehicle includes the capability of utilizing its lifting and retracting mechanism for carrying or stacking a load behind the centerline of the front tires, the amount of weight that the vehicle can transport without tipping is increased. Loads having a weight exceeding the capacity of a single lifting operation can also be transported apart from the lifting mechanism.

The vehicle of the present invention is able to reach and stack loads located substantially away from the vehicle. Nevertheless, without requiring undue vehicle length or weight or excess ballast, while reaching and lifting maximum loads the vehicle does not tip. The high-capacity lift vehicle is also adapted to operate with interchangeable types of lifting devices. Additionally, the vehicle includes means for adjusting the lateral position of the lifting mechanism or of a lifted load.

What is claimed is:

1. A load handling vehicle, comprising, in combination, a main frame, a plurality of wheels supporting said main frame and defining the wheelbase of said vehicle, lift means including a lift frame pivoted to said main frame and power means for pivotally raising and lowering said lift frame relative to said main frame, reach and retract means including an articulated tilt frame pivotally connected to said lift frame and an articulated swing frame pivotally connected to said tilt frame, said swing frame including at least one generally rearwardly projecting swing arm, load securing and releasing means carried by said swing frame for connecting a load thereto, articulating power means including tilt power means for pivoting said tilt frame relative to said lift frame and swing power means for swinging said swing frame outwardly relative to said tilt frame for securing or releasing a load located outboard of said main frame and said wheelbase and for swinging said swing frame inwardly relative to said tilt frame for carrying said load inboard of said wheelbase, said swing power means including at least one hydraulic piston and cylinder combination interconnected between said swing arm and said tilt frame, said swing frame including a transversely extending portion mounted on said tilt frame for pivotal movement thereon about a generally horizontal transverse axis, said swing arm being connected to said transverse portion for imparting and resisting pivotal movement thereof and including at least one generally downwardly extending strut connected to said transverse portion for supporting said load securing means for lateral swinging movement about a generally longitudinally extending axis substantially perpendicular to said transverse axis, and power shift means for laterally shifting the depending end of said strut about said longitudinal axis.

2. A load handling vehicle as defined in claim 1 wherein said main frame includes a portion thereof for supporting and carrying a load generally inboard of said wheelbase separate from said lift means and said reach and retract means, and said lift means and said reach and retract means being arranged for placing or removing a load on or from said load carrying portion of said main frame.

3. A load handling vehicle as defined in claim 2 wherein said plurality of wheels includes at least a pair of front wheels supporting said main frame adjacent the front end thereof, said front wheels each having an axle and said load carrying portion of said main frame is disposed generally rearwardly of said front wheel axles.

4. A load handling vehicle as defined in claim 3 including outrigger means secured to said main frame and having a portion thereof engageable with the ground for relieving at least a portion of the load on said front wheels and actuating means for selectively engaging said outrigger portion with the ground.

5. A load handling vehicle as defined in claim 4 wherein said outrigger means is secured to said main frame for longitudinal extension and retraction of said outrigger portion and power extending means for selectively extending and retracting said outrigger portion with respect to a location outboard of said front wheels.

6. A load handling vehicle as defined in claim 5 including means cooperating with said actuating means for supporting said outrigger means for substantially longitudinal extension and retraction as said power extending means is selectively energized.

7. A load handling vehicle as defined in claim 1 wherein said main frame includes an upwardly projecting support element and said power tilt means is disposed and interconnected between said support element and said tilt frame in substantially parallel relation to said lift frame.

8. A load handling vehicle as defined in claim 7 wherein said power tilt means includes at least one hydraulic piston and cylinder combination connected between said support element and said tilt frame intermediate the ends thereof.

9. A load handling vehicle as defined in claim 1 wherein said power means for raising and lowering said lift frame includes at least one hydraulic piston and cylinder combination with one of said piston and cylinder being connected to said main frame and the other of said piston and cylinder being connected to said lift frame intermediate the ends thereof.

10. A load handling vehicle as defined in claim 1 wherein said load securing and releasing means includes an electromagnet.

11. A load handling vehicle as defined in claim 1 wherein said load securing and releasing means includes an actuable tong assembly, said tong assembly including at least one tong actuator and a pair of depending tongs for gripping and carrying a load.

12. A load handling vehicle as defined in claim 1 wherein said load securing and releasing means includes at least one prong extending substantially longitudinally relative to the vehicle.

13. A load handling vehicle as defined in claim 1 wherein said load securing and releasing means includes a pair of prongs extending substantially longitudinally relative to the vehicle and including means for laterally shifting each of said prongs independently of one another.

14. A load handling vehicle as defined in claim 1 wherein said load securing and releasing means includes at least one fork extending substantially longitudinally relative to the vehicle.

* * * * *